United States Patent [19]

Garnett

[11] 4,429,354

[45] Jan. 31, 1984

[54] LIGHTING FIXTURE LOUVER

[75] Inventor: Willard R. Garnett, Tupelo, Miss.

[73] Assignee: Emerson Electric Co., St. Louis, Mo.

[21] Appl. No.: 427,657

[22] Filed: Sep. 29, 1982

[51] Int. Cl.[3] ..... F21V 7/00

[52] U.S. Cl. ..... 362/342; 362/217; 362/235; 362/297; 362/346; 362/347; 362/349; 362/362

[58] Field of Search ..... 362/342, 217, 235, 297, 362/346, 347, 349, 362

[56] References Cited

U.S. PATENT DOCUMENTS

| | | | |
|---|---|---|---|
| 3,124,310 | 3/1964 | Lipscomb | 362/342 |
| 4,268,897 | 5/1981 | Schierwagen et al. | 362/290 |

*Primary Examiner*—Stephen J. Lechert, Jr.

*Attorney, Agent, or Firm*—Polster, Polster and Lucchesi

[57] ABSTRACT

In a lighting fixture louver assembly in which a plurality of louvers with side walls joined at their lower edges by a closed bottom, generally V-shaped in end elevation, are connected to side or end rails, an extension is provided of the lower portion of the louvers, projecting beyond a contiguous upper portion of the ends of the side walls, and cut wings are formed in the extension. The rails have a slot in a side wall extending upwardly from immediately adjacent the bottom edge of the wall and of a size to receive the extension. The extension projects through the slot, and the wings are bent outwardly laterally along a line substantially parallel to the long axis of the louver, a cut surface of each of the wings engaging the back surface of the side wall, whereby the closed bottom of the louver projects uninterruptedly through the side wall of the rail.

5 Claims, 31 Drawing Figures

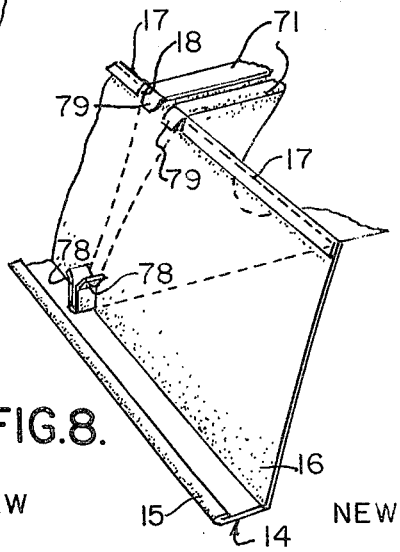
FIG. 8.
NEW
NEW OPTIONAL

LIGHTING FIXTURE LOUVER

BACKGROUND OF THE INVENTION

In a conventional lighting fixture louver assembly, the longitudinally extending, male, louvers and the cross, female, louvers are mounted to the end and side rails respectively by means of tabs formed on the side rail end wall above the bottom of the louver, which is V-shaped in end elevation. These tabs extend through slots in the rails, also positioned substantially above the lower edge of the rail, and are bent back flat against the face of the inside surface of the rail along lines generally perpendicular to the long axis of the louver. Tabs projecting from flanges at the top edges of the louvers are bent over the top edge of the rail. In this construction, the end of the louver butts the exposed outer or front face of the rail.

It is desirable to use light gauge metal for the louvers, both as a matter of making the lighting fixture as light in weight as possible, and in the interest of economy of materials. When the metal becomes very thin, for example, 0.016", there is a tendency for the tabs to bend back sufficiently to permit a slight separation of the ends of the louvers from the rails, particularly at the bottom, where it is likely to be observed when the louver is in use.

One of the objects of this invention is to provide a lighting fixture louver assembly in which the rails and louvers are held securely, and in which there is no possibility of an apparent discontinuity between the bottom edge of the louver and the rail.

Another object is to provide such a construction that is economical and that permits automated assembly.

Other objects will become apparent to those skilled in the art in the light of the following description and accompanying drawing.

SUMMARY OF THE INVENTION

In accordance with this invention, generally stated, in a lighting fixture louver assembly in which a plurality of louvers, of a generally V-shape in end elevation, are connected to side or end rails, an extension is provided of the lower portion of the louver, projecting beyond a contiguous upper portion of the end, and cut wings are formed in the extension. The rails have a slot in a side wall extending upwardly from immediately adjacent the bottom edge of the wall and of a size to receive the extension. The extension projects through the slot, and the wings are bent outwardly laterally along a line substantially parallel to the long axis of the louver, a cut surface of each of the wings engaging the back surface of the side wall, whereby the closed bottom of the louver projects uninterruptedly through the side wall of the rail. This not only ensures that there is no discontinuity in the line of the lower edge of the louver at the rail, but the cut edge provides a tight engagement and the longitudinal extent of the wings provides high strength. Similar extensions and wings can be provided near but below the upper edges of the louver. The principle of the invention can be applied to framing of the light fixture by main and side rail gussets.

BRIEF DESCRIPTION OF THE DRAWINGS

In the drawing

FIG. 8 is a view in perspective showing a side rail and cross louver of this invention;

DESCRIPTION OF THE PREFERRED EMBODIMENT

Figure 1:
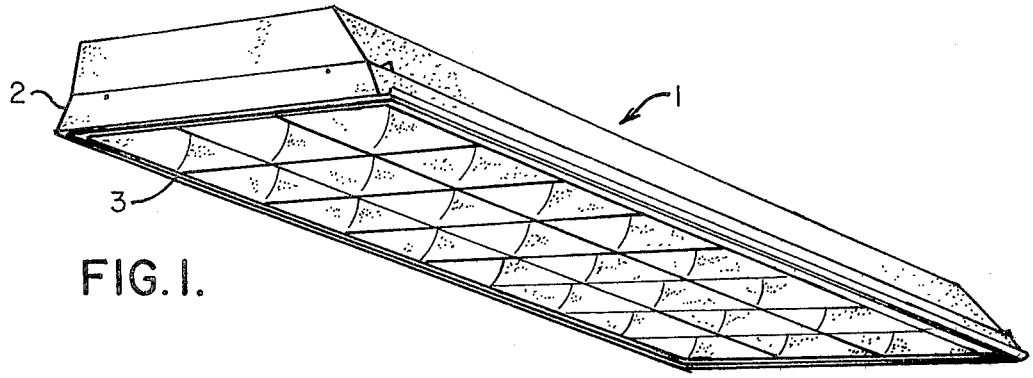
FIG. 1 is a view in perspective looking up at a lighting fixture provided with a louver assembly of this invention.

Referring now to the drawing, reference numeral 1 indicates a lighting fixture with a housing 2 in which is mounted a louver assembly 3. The housing and the method of mounting the louver assembly in it are conventional.

The louver assembly 3 is made up of side rails 4, end rails 5, longitudinal, male, louvers 6, and cross, female, louvers 7.

Referring now to FIG. 8, each of the side rails 4 has at its lower edge an outboardly extending side rail flange 14 with a turned edge 15, an upwardly inboardly bowed, upwardly extending wall 16 with a turned top edge 17. The turned edge is interrupted with spaced interruptions 18.

Figure 2:
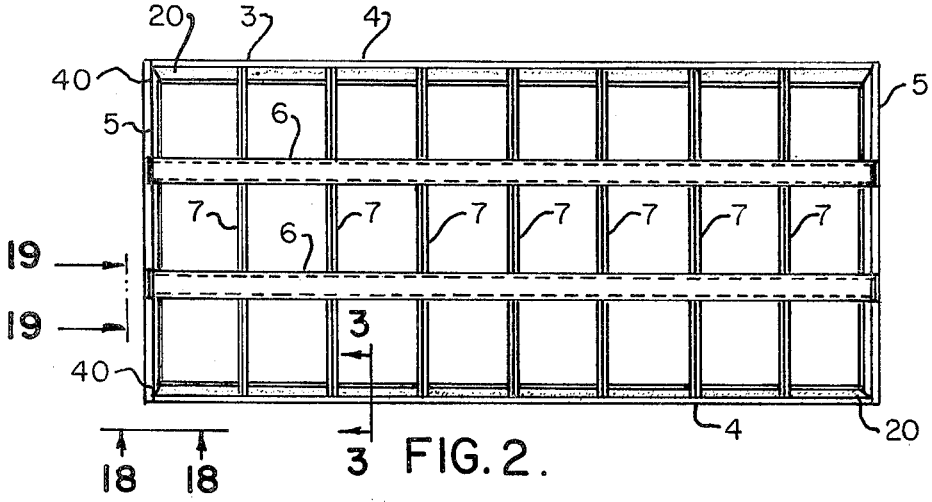
FIG. 2 is a top plan view of one embodiment of louver assembly of this invention, out of the fixture housing.
Figure 3:
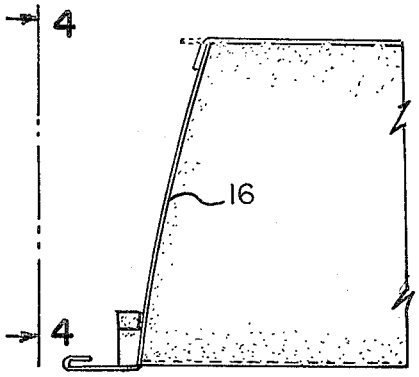
FIG. 3 is a sectional view taken along the line 3—3 of FIG. 2.
Figure 7:
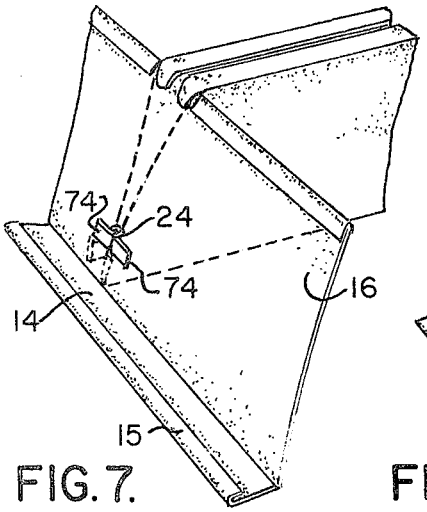
FIG. 7. PRIOR ART
FIG. 7 is a fragmentary view in perspective of a prior art side rail and louver.
Figure 16:
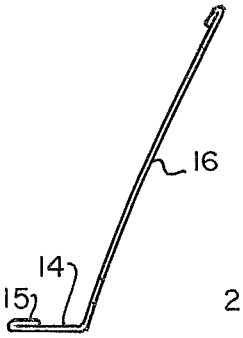
FIG. 16 is a view in end elevation of a side rail of this invention.
Figure 17:
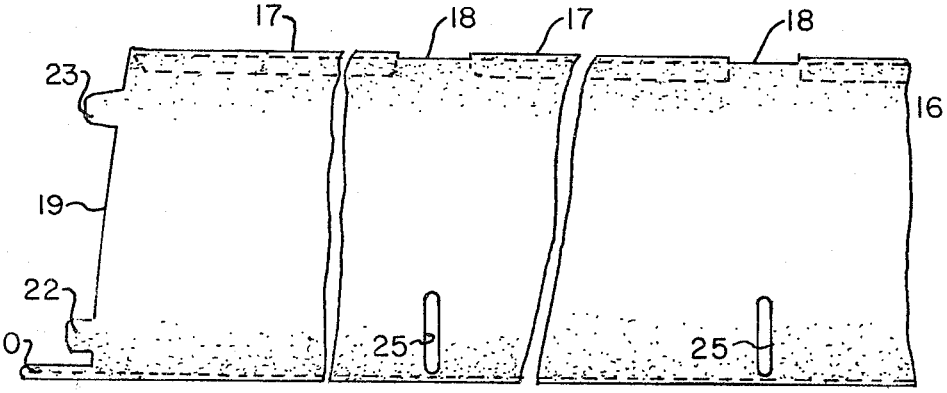
FIG. 17 is a fragmentary view in side elevation of the side rail shown in FIG. 16.

Referring now to FIGS. 16 and 17, each end 19 of the side rail, which ends are mirror images of one another, has a flange miter 20, shown particularly in FIG. 2, a lower tab 22 and an upper tab 23. All of these elements of the side rail flange are conventional. In the conventional side rail, spaced slots 24, as shown in FIG. 7, are positioned substantially above the flange 14. In the side rail of the present invention, slots 25 extend from the level of the upper surface of flange 14 upwardly, short of but centered with respect to an interruption 18 in the turned top edge 17.

Each end rail has an end rail flange 34 with a turned edge 35, an upwardly extending inboardly bowed wall 36 from the top edge of which a lip 37 tends outboardly. The lip 37 is interrupted to provide interruptions 38. At the ends 39 of the end rails, which ends are mirror images of one another, are a flange miter 40, again shown in FIG. 2, and an edge flap 41. At the junction of the edge flap and the wall 36, are a lower slot 42 and an upper slot 43, through which the side rail tabs 22 and 23 project and are bent over, as shown particularly in FIG. 18. This construction is also conventional. The slots in the wall 36 of the prior art end rails are not illustrated but they correspond to the slots 24 shown in the side wall in FIG. 7. In the end rail of this invention, inverted triangular slots 45, with their apex at the level of the upper surface of flange 34 extend upwardly short of but centered with respect to the interruptions 38.

Figure 11:
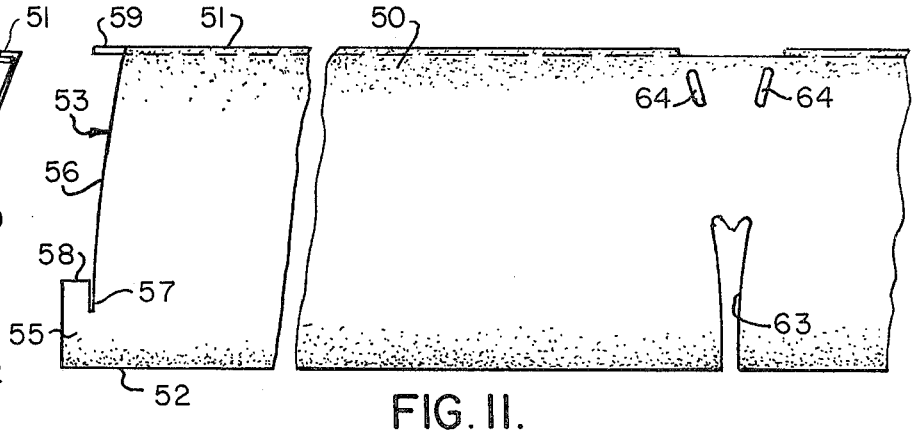
FIG. 11 is a fragmentary view in side elevation of the louver shown in FIG. 10.
Figure 12:
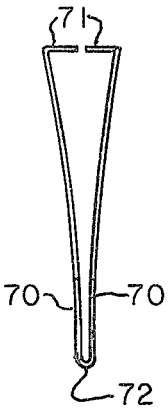
FIG. 12 is a view in end elevation of a cross, female, louver of this invention.
Figure 13:
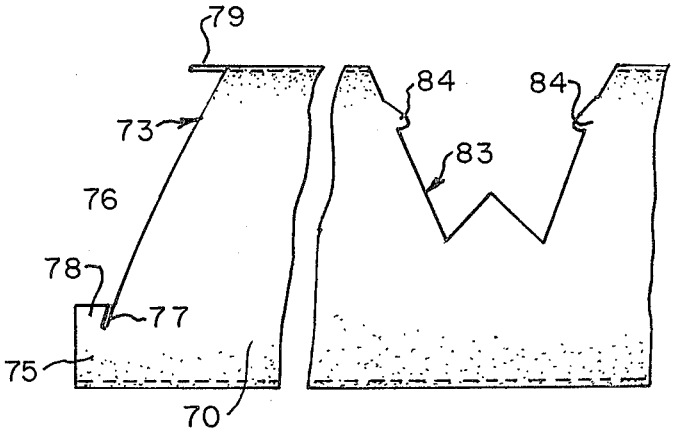
FIG. 13 is a fragmentary view in side elevation of the louver shown in FIG. 12.
Figure 14:
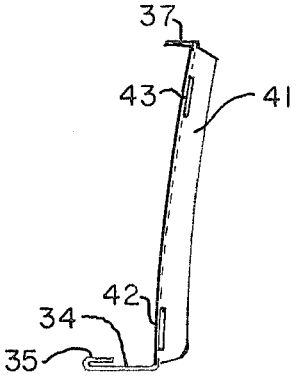
FIG. 14 is a view in end elevation of an end rail of this invention.
Figure 15:
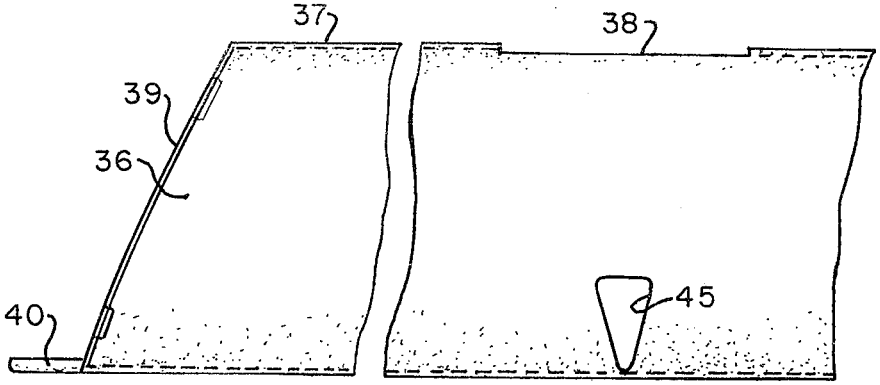
FIG. 15 is a fragmentary view in side elevation of the end rail shown in FIG. 14.
Figure 19:
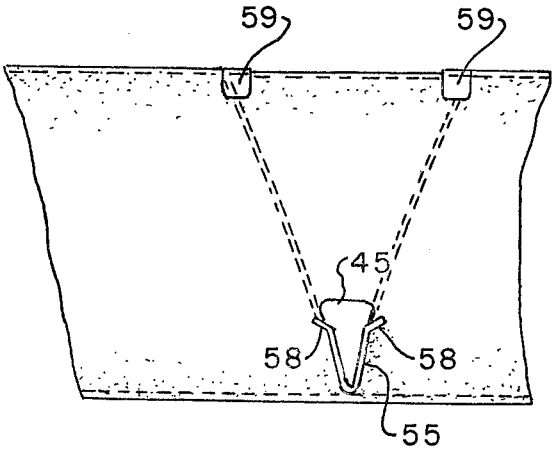
FIG. 19 is a view in side elevation of an end rail to which a male louver is connected.

The male louvers have slightly concave side walls 50 converging downwardly to a closed bottom 52, and forming a relatively wide V as compared with the female louver. Inturned upper edge flanges 51 extend along the upper edges of the side walls 50. At their ends 53, which are mirror images of one another, the male louvers of this invention have extensions 55 of the bottom 52 and a lower section of both of the side walls 50 beyond an upper section 56 of the walls at the end 53. The upper section 56 is curved convexly complementarily to the bow of end rail wall 36. A cut 57, from the junction of the upper section 56 and the extension 55 toward but short of the bottom 52 defines wings 58 integral with the extensions 55. It can be seen that the wings project in a direction parallel to the long axis of the louver, and the cut, in a direction generally perpendicular to that axis. In the embodiment shown in FIGS. 11 and 19, the flanges 51 project beyond the edge of the upper section 56 to provide flange tabs 59. The male louvers are provided with the conventional cross louver slots 63 extending through the bottom edge, and spaced upper cross louver slots 64.

Figure 5:
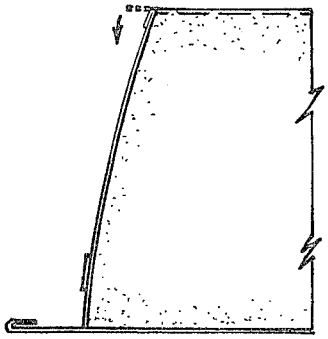
FIGS. 5 and 6 are views corresponding to those of FIGS. 3 and 4, respectively, showing the prior art construction.
Figure 6:
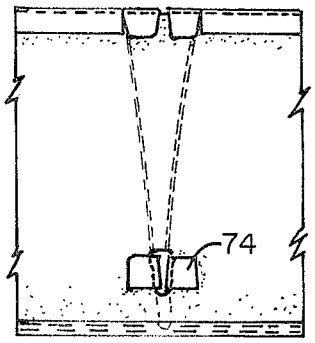

The female louvers 7 have side walls 70, slightly concave and forming a substantially narrower V than the male louvers. At their upper ends, the side walls 70 are provided with inturned upper edge flanges 71; at their lower edges, they are joined by a closed bottom 72. At their ends 73, which are mirror images of one another, the prior art female louvers were provided with tabs 74, which extended through the slots 24 in the side rails and were bent back flush against the inner surface of the side walls 16 along a line substantially perpendicular to the long axis of the louver, as shown particularly in FIGS. 5, 6 and 7. The female louver of the present invention has an extension 75 of the bottom 72 and a lower section of the two side walls 70, projecting beyond an upper section 76 of the walls at the ends 73. The upper section 76 of the end is curved convexly complementarily to the bow of the side rail wall 16. A cut 77, slightly offset outwardly from the juncture of the extension and upper section, extending from the top edge of the extension 75 in each of the walls 70 generally, though not absolutely, perpendicularly to the long axis of the louver, defines wings 78. The flanges 71 project beyond the upper edge of the upper section 76 to form flange tabs 79. The side walls 70 are provided with conventional male louver-receiving openings 83 and detents 84 that spring into the slots 64 in the male louver side wall when the louvers are assembled.

Figure 4:
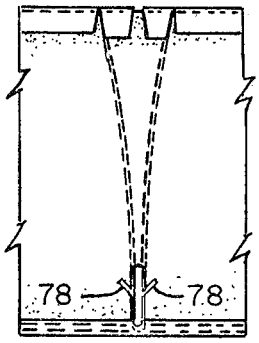
FIG. 4 is a view in side elevation taken along the line 4—4 of FIG. 3.
Figure 18:
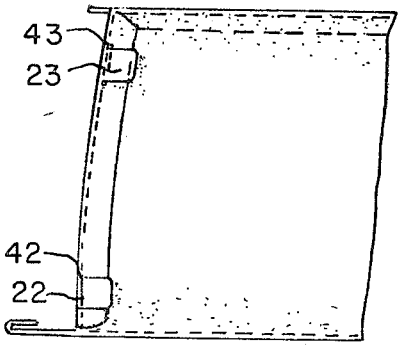
FIG. 18 is a fragmentary view in side elevation of an assembled corner of side and end rail shown in FIGS. 14 through 17.

In assembling the louver assembly of this invention, the male and female louvers are assembled to one another in the conventional way. The side rails are then mounted to the ends of the female louvers by putting the extensions 75 through the slots 25, and bending the wings 78 laterally outwardly, along lines substantially parallel to the long axis of the louvers as shown in FIGS. 4 and 8. In this embodiment, the flange tabs 79 are then bent down over the interrupted upper edge of the turned top edge, again as shown in FIG. 8, the turned edges 17 serving among other things to inhibit spreading of the walls. The end rails are then assembled by putting the extensions 55 of the male louvers 6 through the slots 45, and the tabs 22 and 23 of the side rails 14 through the slots 42 and 43, bending the tabs 22 and 23 as shown in FIG. 18, and spreading the wings 58 of the extensions 55, again, on lines substantially parallel to the long axes of the louvers, and bending down the tabs 59 over the interruptions 38 between spaced sections of the lip 37. Particularly because of the bowing of the walls of both rails, the cut edges of the wings engage the back surface of the rail side wall tightly when they are spread.

Figure 9:
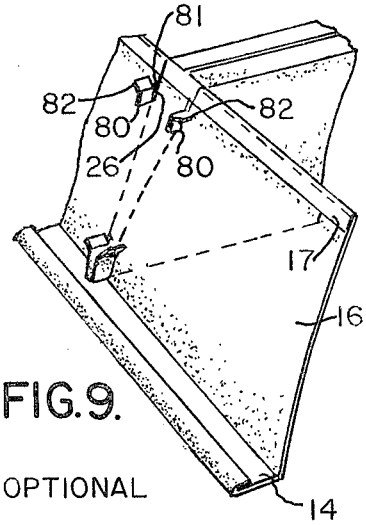
FIG. 9 is a fragmentary view in perspective showing a side rail and cross louver in accordance with a second embodiment of this invention.
Figure 10:
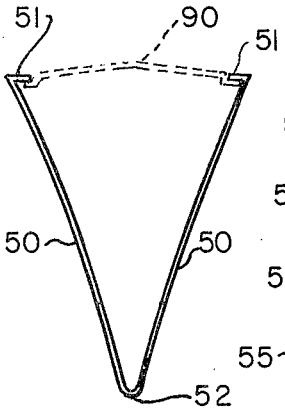
FIG. 10 is a view in end elevation of a longitudinal, male, louver of this invention.

In the embodiment shown in FIG. 9, upper extensions 80, with cuts 81, extend through slots 26, and wings 82 are spread along lines substantially parallel to the long axis of the louvers. These upper extensions can be provided on either the male or female louvers or on both, the reguired slots being made in the end or side rails or both as the case may be. When such slots are provided, it is unnecessary to interrupt the turned edges 17 or the flanges 37, the slots serving both to locate and to hold the side walls against lateral distortion.

In either embodiment, but particularly the first embodiment, a spreader 90 can be inserted in the open mouth defined by the flanges 51 of the male louvers. It can be seen that the wings 58 and 78, and 82 in the second embodiment, have enormous strength against distortion in the direction of the long axis of the louvers, and that, because the bottom of the louvers extends uninterruptedly through the side walls of the rails, there can be no separation visible between the louvers and the side and end rails.

Merely to indicate scale, the absolute dimensions forming no part of this invention, the extension on a male louver 2 3/32" tall can be ¼" long and ⅜" high; the cuts, ⅛" deep and substantially vertical. The extension on a female louver of the same height can be ⅜" high and 0.27" long, and the cuts, ⅛" deep. However, in the commercial embodiment, the cut in the female louver is offset outwardly from the adjacent edge of the upper portion of the end by about 0.02", and extends at an angle of about 75° from the vertical, to accommodate the apparent greater curvature of the side rail wall that results from the fact that the side walls of the extension of the female louver are more nearly vertical than those of the male louver.

Referring now to FIGS. 20 through 30 for an illustrative embodiment of gusset assembly employing a winged tongue, reference numeral 101 indicates a ceiling grid made up of suspended longitudinal rails 102 and cross rails 103, suspended by the usual supporting wires 104. A gusset assembly 110, serving as a framing support structure for a lighting fixture, i.e., forming a luminaire opening, is made up of main rail gussets 113 and 114 and side rail gussets 116 and 117. The main rail gussets 113 and 114, which face one another as mirror images, rest upon and are supported by ceiling grid rails 103. The side rail gussets 116 and 117 are mounted on and supported by the main rail gussets 113 and 114.

Referring now to FIGS. 23 through 27, each of the main rail gussets 113 and 114 has an upstanding flange 120, tending outboardly slightly, e.g., 10°, from the vertical, a horizontal upper ledge 121, a vertical wall 122 and a horizontal shelf 123. Tabs 124 lanced out of the free edge of the shelf 123 serve a locating and centering function which forms no part of this invention. The flange 120 and ledge 121 are also notched, for reasons that form no part of this invention. The vertical wall 122 is provided with substantially parallelepipedal slots 130 and 131 inclined, in this embodiment, about 17° from the vertical toward each other, in an upwardly convergent direction. The shelf 123 and vertical wall 122 are cut away at the ends of the main rail gusset to form a step 135 to rest upon the upper surface of the rails 103.

Figure 28:
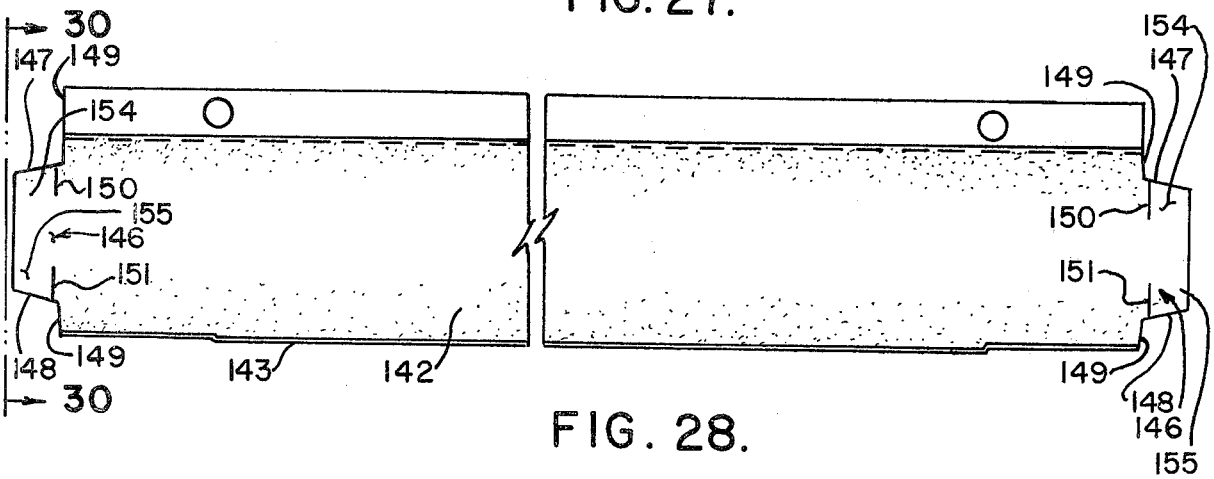
FIG. 28 is a fragmentary view in side elevation of a cross rail gusset.
Figure 29:
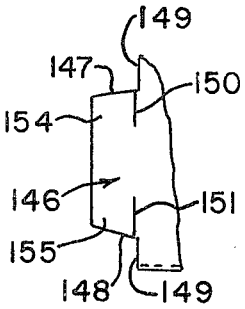
FIG. 29 is a fragmentary view in side elevation of the other side of an end of the side rail gusset.
Figure 30:
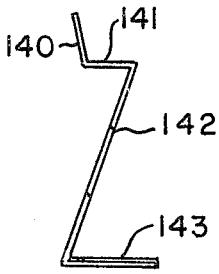
FIG. 30 is a view in end elevation taken along the line 30—30 of FIG. 28.

Referring now to FIGS. 28 through 30, each of the side rail gussets, which are also identical but facing, so as to be mirror images of one another in the assembled frame, has a flange 140, also tending outboardly at a small, e.g., 10°, angle, a horizontal ledge 141, a side wall 142, which, in this embodiment, tends from the vertical, in the opposite direction from the flange 140, at a somewhat steeper angle, e.g., 20° from the vertical, and a horizontal shelf 143. The shelf 143 is offset at the two ends of the side rail gusset by the thickness of the shelf 123 of the main rail gusset, upon which the offset portion of the shelf 143 rests. At the ends of the side wall 142, the side rail gusset is provided with tongues 146. The tongues 146 have convergently outwardly extending upper and lower edges 147 and 148, extending from vertical end edges 149 of the side wall. Upper cuts 150 and lower cuts 151 in the tongues 146, extend toward one another in substantial vertical alignment and are offset outboardly of the end edges 149 a distance corresponding to the thickness of the vertical wall 122 of the main rail gusset. The cuts 150 and 151 define wings 154 and 155 in the tongues 146.

Figure 20:
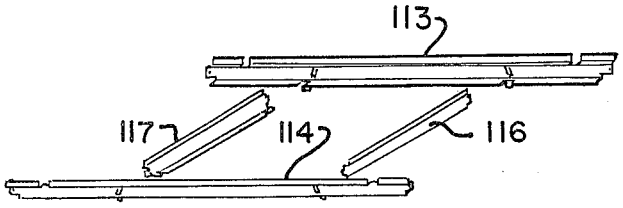
FIG. 20 is an exploded view in perspective of framing for a louver assembly.
Figure 21:
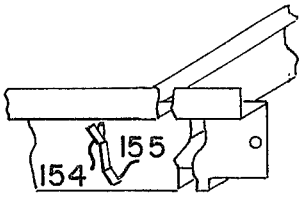
FIG. 21 is a fragmentary detail view in perspective of a connection between a side and main rail gusset.
Figure 22:
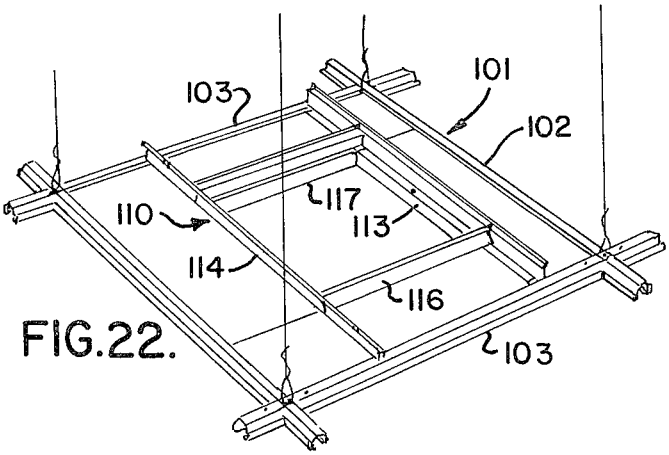
FIG. 22 is a fragmentary view in perspective of an assembled frame.
Figure 23:
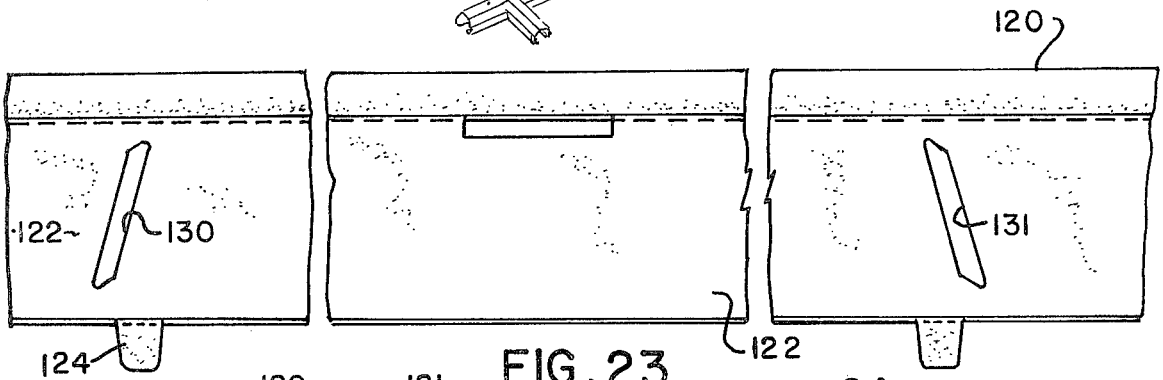
FIG. 23 is a fragmentary view in side elevation of a main rail gusset.
Figure 23A:
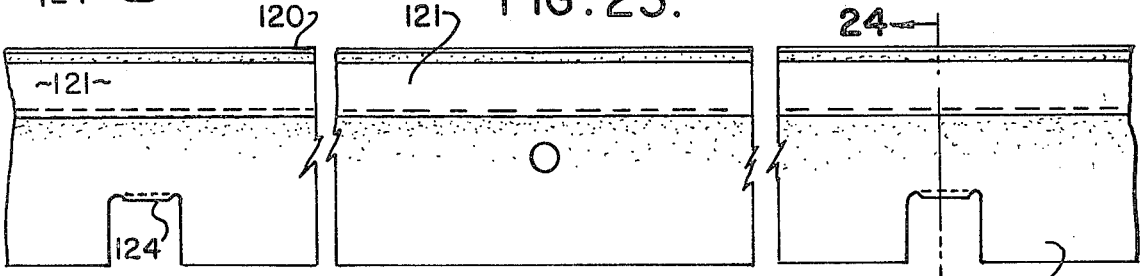
FIG. 23A is a fragmentary top plan view of the main rail gusset shown in FIG. 23.
Figure 24:
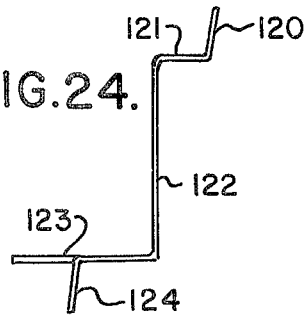
FIG. 24 is a sectional view taken along the line 24—24 of FIG. 23A.
Figure 25:
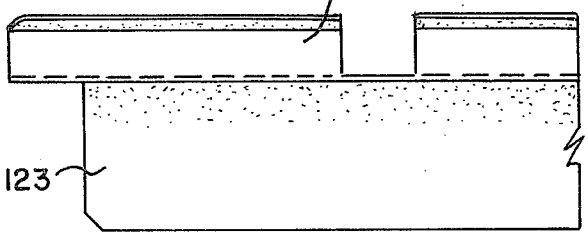
FIG. 25 is a fragmentary plan view of an end of the main rail.
Figure 26:
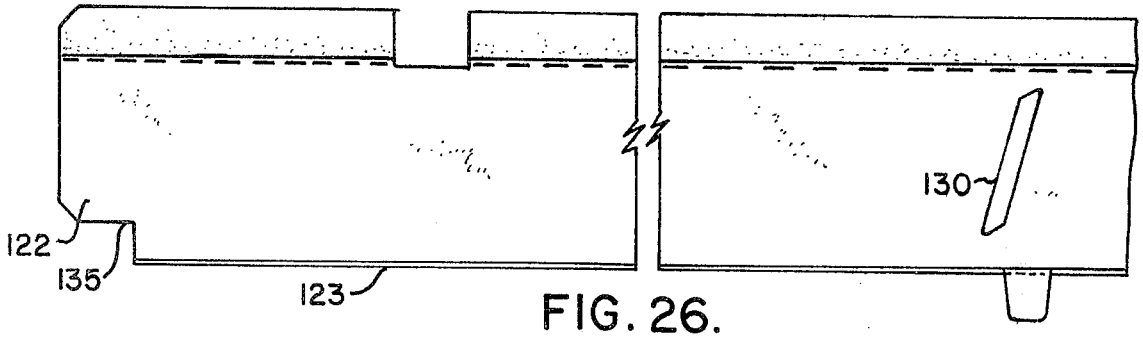
FIG. 26 is a fragmentary view in side elevation of an end of the main rail.
Figure 27:
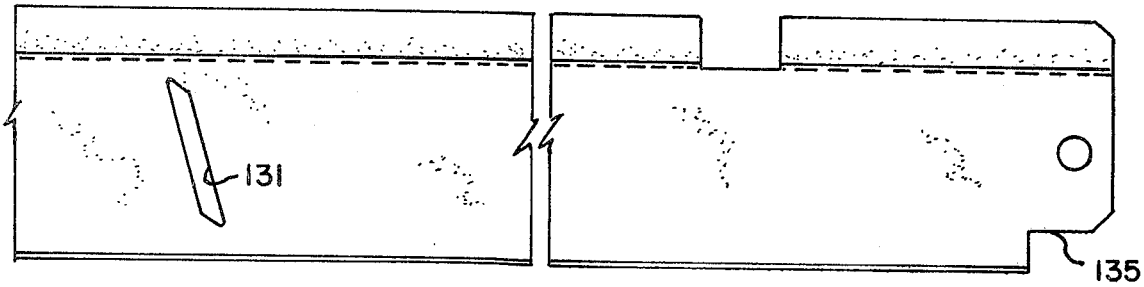
FIG. 27 is a fragmentary view in side elevation of the other end of the main rail.

In assembling the frame, the side and main rail gussets are put into the positions shown in FIG. 20, the tongues 146 of the side rails are inserted through the slots 130 and 131 of the main rails, and the upper wing 154 of each tongue is twisted toward the luminaire opening, i.e., toward the other side rail, and the lower wing 155 is twisted away from the luminaire opening, as shown in FIG. 21. It is to be noted that the slant of the tongue, being in the plane of the side wall 142, is a few degrees, in the illustrative embodiment, three degrees, different from that of the slots. This permits the use of a thicker punching die for the slots. As in the case of the louvers, the cut surface of the wings of the side rail gussets engage the back surface of the wall 122 of the main rail gusset.

Numerous variations in the construction of the assembly of this invention, within the scope of the appended claims, will occur to those skilled in the art in the light of the foregoing disclosure. For example, if there were any problem of upward displacement of the louvers with respect to the side and end rails, the upper extensions 80 can be made upside down from the arrangement shown in FIG. 9, with the wings at the bottom, and the upper edges of the extension contiguous the wall edge defining the upper edge of the slots 26, or the wings can be formed intermediate the top and bottom of the extension, using an L-shaped cut. Alternatively, the lower extension-receiving slots can be made V shaped, complementary to the shape of the extension in end elevation, and of a size to provide a downwardly extending holding tongue engaging an inner surface of the extension. Conventional tabs, spaced from the upper edge of the wall, can also be used for the purpose, but they will lack the strength of the wings of this invention. Different means of mounting can be used for the male and female louvers and for different ends of either or both, although the use of the mounting arrangement of this invention for both ends of each of the louvers is much preferred. Different configurations of the various components are not only possible but expected. These are merely illustrative.

I claim:

1. In a lighting fixture louver assembly in which a plurality of louvers, generally V-shaped in end elevation with side walls forming a narrow lower portion joined by a closed bottom, are connected to side or end rails, the improvement comprising an extension of a lower portion of said side walls and bottom at an end of said louvers projecting beyond a contiguous upper portion of said end, and cut wings integral with said lower portion, said rails having in a side wall slots extending upwardly from immediately adjacent the bottom edge of said wall and of a size to receive said extension, said extension projecting therethrough, said wings being spread laterally along lines substantially parallel to the long axis of said louver behind and a cut surface of each of said wings engaging the back surface of said side wall, said closed bottom of said louver projecting uninterruptedly through said side wall of said rail.

2. The improvement of claim 1 including an upper extension of each of said louver side walls, below an upper edge of the said walls, said rails having slots in said rail side wall below the upper edge thereof to receive said extensions, and wings on said extensions, said extensions extending through said slots and said wings being spread along lines substantially parallel to the long axis of said louver.

3. In a lighting fixture gusset assembly in which main and side rail gussets are connected to define a luminaire opening, the improvement comprising slots in a wall of the main rail gussets and tongues integral with and projecting from a wall of said side rail gussets, each of said tongues projecting through one of said slots, and cut wings integral with said tongues, said wings being spread laterally along lines substantially parallel to the long axis of the said side rail gusset behind and a cut surface of each of said wings engaging the back surface of said main rail gusset.

4. The improvement of claim 3 wherein the slots in the main rail gusset wall are slanted convergently upwardly, and the side wall of the side rail gusset slants in the same general direction but at a different angle from the vertical, the tongues of the side rail gusset lying in the same plane as the said side wall.

5. The improvement of claim 1 including a flange extending along and projecting inboardly from the upper edge of each louver side wall toward one another and projecting as a tongue beyond said upper edge at an end of said louver in a plane substantially parallel to an upper edge of a contiguous rail and extending over said upper edge of said rail, and being bent down thereover along a line parallel to the said upper edge of said rail.

* * * * *